US009905386B2

(12) United States Patent
Park

(10) Patent No.: US 9,905,386 B2
(45) Date of Patent: Feb. 27, 2018

(54) RELAY

(71) Applicant: LSIS CO., LTD., Gyeonggi-do (KR)

(72) Inventor: Sanghee Park, Gyeonggi-do (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 0 days.

(21) Appl. No.: 15/277,875

(22) Filed: Sep. 27, 2016

(65) Prior Publication Data

US 2017/0221664 A1 Aug. 3, 2017

(30) Foreign Application Priority Data

Feb. 2, 2016 (KR) ..... 10-2016-0013084

(51) Int. Cl.
*H01H 9/30* (2006.01)
*H01H 50/64* (2006.01)
(Continued)

(52) U.S. Cl.
CPC ..... *H01H 50/645* (2013.01); *H01H 9/443* (2013.01); *H01H 50/546* (2013.01);
(Continued)

(58) Field of Classification Search
CPC ..... H01H 9/30; H01H 9/34; H01H 50/40; H01H 51/22; H01H 67/02
(Continued)

(56) References Cited

U.S. PATENT DOCUMENTS 4,039,984 A * 8/1977 DeLucia ..... H01H 1/58 335/151
4,310,818 A * 1/1982 Essler ..... H01H 11/06 200/246
(Continued)

FOREIGN PATENT DOCUMENTS

DE 10 2008 039704 A1 3/2010
EP 2 919 248 A1 9/2015
(Continued)

OTHER PUBLICATIONS

Search Report dated Jun. 21, 2017 for European Patent Application No. 16189703.8, in 7 pages.
(Continued)

*Primary Examiner* — Shawki S Ismail
*Assistant Examiner* — Lisa Homza
(74) *Attorney, Agent, or Firm* — K&L Gates LLP

(57) ABSTRACT

Some embodiments of the present disclosure relate to a relay capable of preventing a chattering phenomenon, and capable of solving an unbalanced contact state occurring when contacts come in contact with each other.

The relay may include: a stationary contact having a first stationary contact and a second stationary contact; a movable contact moveable to a first position to contact the first stationary contact, and a second position to be separated from the first stationary contact; a conductive connector configured to always electrically connect the movable contact with the second stationary contact; and a driving mecha-
(Continued)

nism configured to provide a driving force to the movable contact such that the movable contact is moveable to the first position or the second position.

5 Claims, 14 Drawing Sheets

(51) Int. Cl.
*H01H 50/86* (2006.01)
*H01H 9/44* (2006.01)
*H01H 50/54* (2006.01)
*H01H 50/60* (2006.01)
*H01H 1/58* (2006.01)

(52) U.S. Cl.
CPC ..... *H01H 50/60* (2013.01); *H01H 50/86* (2013.01); *H01H 1/5822* (2013.01); *H01H 2201/002* (2013.01); *H01H 2235/01* (2013.01)

(58) Field of Classification Search
USPC ..... 335/201
See application file for complete search history.

(56) References Cited

U.S. PATENT DOCUMENTS 4,924,197 A 5/1990 Siepmann
5,572,176 A * 11/1996 Heinzl ..... H01H 50/642 335/129
5,757,255 A * 5/1998 Noda ..... H01H 50/642 335/129
6,075,429 A * 6/2000 Uotome ..... H01H 50/645 335/129
7,046,107 B2 * 5/2006 Yamamoto ..... H01H 1/50 335/128
7,423,504 B2 9/2008 Kon et al.
7,495,535 B2 * 2/2009 Mikl ..... H01H 50/36 335/179
7,782,162 B2 * 8/2010 Nishida ..... H01H 9/443 335/201
8,354,906 B2 * 1/2013 Nagura ..... H01H 9/443 335/128
8,390,410 B2 * 3/2013 Kojima ..... H01H 9/443 335/128
8,642,906 B2 * 2/2014 Yeon ..... H01H 50/023 200/430
8,941,453 B2 * 1/2015 Yano ..... H01H 1/66 335/131
9,330,872 B2 * 5/2016 Kubono ..... H01H 50/54
9,502,906 B2 11/2016 Hashimoto et al.
2002/0050885 A1 * 5/2002 Gruner ..... C22C 9/00 335/129
2009/0072935 A1 * 3/2009 Yuba ..... H01H 9/443 335/201
2013/0313915 A1 11/2013 Hashimoto et al.
2015/0206666 A1 7/2015 Naka et al.
2015/0262777 A1 9/2015 Tsurusu et al.

FOREIGN PATENT DOCUMENTS

JP H04-068334 U 6/1992
JP 2000-67725 A 3/2000
JP 2003-36776 A 2/2003
JP 2012-199136 A 10/2012
JP 2014232669 A 12/2014

OTHER PUBLICATIONS

Japanese Office Action for related Japanese Application No. 2016-226655; action dated Dec. 5, 2017; (3 pages).

* cited by examiner

RELAY

CROSS-REFERENCE TO RELATED APPLICATIONS

This application claims the benefit of Korean Application No. 10-2016-0013084, filed on Feb. 2, 2016, the content of which is hereby incorporated by reference in its entirety.

BACKGROUND

1. Technical Field

The present disclosure relates to a relay, and more particularly, to a relay having a single movable contact with respect to two stationary electrodes.

2. Background

In an electric vehicle, a battery disconnect unit is used to supply a DC electric power from a battery to an inverter or interrupt the electric power supply.

The battery disconnect unit includes two main relays for positive and negative direct current (DC) supplying paths, and one pre-charge relay for protecting the main relays from an inrush current.

The pre-charge relay serves to temporarily switch on to protect the main relays from an inrush current generated when an electric vehicle is started.

Some embodiments of the present disclosure may be applied to such a pre-charge relay, but is not limited to this. That is, some embodiments of the present disclosure may be applied to various types of relays.

A relay 100 in accordance with the conventional art will be explained with reference to FIGS. 1 to 9.

Referring to FIG. 1, the conventional relay 100 has a rectangular parallelepiped shape, and includes main circuit terminals 1 formed at an upper part thereof and control signal receiving terminals 2 formed at a lower part thereof. The main circuit terminals 1 are exposed to the front side in a protruding manner, and are connected to a main circuit for supplying a direct current. And the control signal receiving terminals 2 are exposed to the front side in a protruding manner, and are configured to receive a control signal to open or close the relay 100 (so called, a magnetizing control signal). The control signal to open or close the relay 100 may be provided as a voltage signal of DC 12V.

Referring to FIG. 1, reference numeral 50 denotes an enclosure to accommodate therein components of the conventional relay 100.

The relay according to some embodiments of the present disclosure may have the same or similar appearance as or to the conventional relay shown in FIG. 1, and thus showing of the appearance of the relay according to some embodiments of the present disclosure will be omitted.

The inner configuration of the conventional relay 100 will be explained with reference to FIGS. 2 to 6.

Referring to FIG. 6, the conventional relay 100 comprises an upper mechanism assembly 20, a movable part assembly 30, a magnetic coil assembly 40, an enclosure 50, and a lower cover 60.

As shown in FIG. 3, the upper mechanism assembly 20 includes main circuit terminals 1, stationary contacts 3, ferromagnets 12, a return spring 13, an upper cover 21, insulating supporting portions, etc.

FIG. 3 illustrates a configuration of the upper mechanism assembly 20, which shows the upper mechanism assembly 20 upside down. The upper mechanism assembly 20 is assembled with other components with a posture shown in FIG. 6.

The main circuit terminals 1 have conductor parts of a thin bar shape. Although not shown in FIG. 3 due to the insulating supporting portions, the conductor parts extend to the inside of the relay 100 passing through the upper cover 21. In FIG. 3, contact parts visible below the stationary contacts are partial regions of the conductor parts.

The stationary contacts include one stationary contact connected to a positive side main circuit terminal 1 and another stationary contact connected to a negative side main circuit terminal 1. And the pair of stationary contacts are welded on the contact parts of the main circuit terminals 1, respectively.

The ferromagnet 12 is configured with a permanent magnet having a ferromagnetism. And two ferromagnets are formed on right and left sides of each stationary contact 3. The ferromagnets 12 extinguish an arc generated when movable contacts 4 are separated from the stationary contacts, by inducing the arc to sides of the stationary contacts 3 and the movable contacts 4 by a magnetic flux generated nearby.

The return spring 13 has one end supported by the insulating supporting portions between the pair of stationary contacts 3, and another end supported by a recessed portion formed at an upper end of the movable part assembly 30. And the return spring 13 provides an elastic force to the movable part assembly 30, in a direction that biases the movable part assembly 30 to be far from the stationary contact 3. Thus, once a coil (refer to reference numeral 6 in FIG. 2 or FIG. 5) of the magnetic coil assembly 40 is demagnetized, the movable part assembly 30 returns to the original position spaced from the stationary contacts 3.

The upper cover 21, configured to shield inner components of the relay 100 from the outside, shields the upper mechanism assembly 20 and the movable part assembly 30 which are disposed at an upper part and a middle part of the pre-charge relay 100, from the outside. The upper cover 21 is differentiated from the lower cover 60 configured to shield the magnetic coil assembly 40 disposed at a lower part of the relay 100 from the outside.

The insulating supporting portions, configured to electrically insulate and support inner extending parts of the main circuit terminals 1 of the relay, the ferromagnets 12, the return spring 13, etc., may be formed of a synthetic resin material having an electrical insulating property.

As shown in FIG. 4, the movable part assembly 30 includes a shaft 5, a movable contact arm 4*a*, a contact spring 7, and a movable core 10.

The shaft 5, a cylindrical member including an upper part having a large diameter and a lower part having a small diameter, may be formed of an electric insulating material.

The upper part having a large diameter of the shaft 5 includes a recessed portion which supports a lower end of the return spring 13; a hollow portion disposed below the recessed portion to accommodate the contact spring 7 therein; and an opening formed in front and rear directions in order to allow inserting the movable contact arm 4*a* thereinto, and open in a vertical direction by a predetermined length.

The lower part having a small diameter of the shaft 5 has a predetermined outer diameter which may be forcibly-inserted into the inner diameter portion of the movable core 10.

The shaft 5 and the movable core 10 may be coupled to each other as the lower part having a small diameter of the shaft 5 is forcibly-inserted into the inner diameter portion of the movable core 10. In the coupled state, the shaft 5 and the movable core 10 are able to move together to the same direction.

The movable contact arm 4*a* is configured with a metallic plate formed of a conductive material such as copper. As shown in FIG. 4, the movable contact arm 4*a* is penetratingly-inserted into the opening of the shaft 5. And the movable contact arm 4*a* is installed such that a central part thereof in a lengthwise direction receives an elastic pressure in upward direction from the contact spring 7 disposed therebelow, for contacting with an upper part of the opening.

The movable contacts 4 are installed on an upper surface of two ends of the movable contact arm 4*a* in a lengthwise direction, by welding.

The contact spring (in other words "contact pressure spring") 7, as a compression spring is installed in the hollow portion of the shaft 5. An upper end of the contact spring 7 supports the central part of the movable contact arm 4*a* in a lengthwise direction, and a lower end of the contact spring 7 is supported by a bottom surface of the hollow portion of the shaft 5.

Thus, the contact spring 7 can be compressed or extended to the original state, in the hollow portion of the shaft 5.

The movable core 10 can be formed with a cylindrical hollow iron core.

As shown in FIG. 2 or FIG. 7, a rubber pad 11 can be forcibly-inserted into a lower end of the movable core 10, for coupling with the movable core 10.

The rubber pad 11 can be provided to attenuate collision noise and an impact generated when the movable core 10 collides with an inner bottom surface of the enclosure 50 when it returns to the lower original position by the return spring 13, when the magnetic coil assembly 40 is demagnetized.

The shaft 5 and the movable core 10 are coupled to each other as the lower part having a small diameter of the shaft 5 is forcibly-inserted into the hollow portion of the movable core 10.

The movable core 10 is magnetized by a magnetic field applied from the magnetic coil assembly 40, and upward-moves in a repulsing manner by a magnetic field of a vertical direction applied from the magnetic coil assembly 40 or is demagnetized together with the magnetic coil assembly 40 when the magnetic coil assembly 40 is demagnetized. Then, the movable core 10 downward-moves by an elastic force of the return spring 13 applied to an upper end of the shaft 5.

As shown in FIG. 5, the magnetic coil assembly 40 comprises a bobbin 8, a coil 6, a yoke 9 and control signal receiving terminals 2.

The bobbin 8 includes a body portion having a hollow cylindrical shape to allow the movable core 10 to be inserted thereinto or to be separated therefrom, and flange portions formed at upper and lower ends of the body portion and configured to determine a winding limit of the coil 6. The coil 6 is wound on the body portion.

The coil 6 is wound on the body portion of the bobbin 8, and is magnetized or demagnetized according to whether a control signal is applied to the control signal receiving terminals 2 or not.

As shown in FIG. 2, the yoke 9 is formed to enclose the bobbin 8, and provides a circulation path of a magnetic flux generated from the coil 6 when the coil 6 is magnetized.

Referring to FIGS. 2 and 5, the control signal receiving terminals 2 are installed to pass through the wound coil 6. When a control signal is received through the control signal receiving terminals 2, the coil 6 is magnetized by the control signal. And the coil 6 is demagnetized when the reception of the control signal is stopped.

Referring to FIG. 1, FIG. 2 or FIG. 6, the enclosure 50 provides a means to accommodate therein the components of the pre-charge relay 100, and may be formed of a synthetic resin material having an electrical insulating property. As shown in FIG. 6, the enclosure 50 may be formed as a rectangular parallelepiped member having one open surface and five closed surfaces, and having an empty inner space, in order to accommodate the components of the relay 100 therein.

Referring to FIG. 6, the lower cover 60, a cover to shield the inner components of the relay 100 from the outside, shields the magnetic coil assembly 40 positioned at a lower part of the relay 100 from the outside. The lower cover 60 is different from the upper cover 21 which shields the upper mechanism assembly 20 and the movable part assembly 30 which are disposed at an upper part and a middle part of the relay 100, from the outside.

The lower cover 60 has two openings formed to correspond to the control signal receiving terminals 2, such that the control signal receiving terminals 2 are exposed to the outside through the openings.

An operation of the relay 100 in accordance with the conventional art will be explained in brief.

Referring to FIG. 2, in an 'off' state of the relay 100, once a control signal is applied through the control signal receiving terminals 2, the coil 6 is magnetized. In this case, the movable core 10 is also magnetized by a vertical magnetic field applied from the coil 6, thereby moving upward.

Then, the shaft 5 of which lower part has been coupled to the movable core 10 moves upward together with the movable core 10, with overcoming an elastic force of the return spring 13. As a result, the movable contact arm 4*a* supported by the shaft 5 and the contact spring 7 also moves upward.

The two movable contacts 4 welded on the upper surface of two ends of the movable contact arm 4*a* move upward to contact the pair of stationary contacts 3 ('ON' state). Such an 'ON' state of the relay is shown in FIG. 7.

As a closed circuit is formed from the positive side main circuit terminal 1 to the stationary contact 3, the movable contacts 4, the movable contact arm 4*a*, the stationary contact 3, and the negative side main circuit terminal 1, a conducting path from the positive side main circuit terminal 1 to the negative side main circuit terminal 1 may be formed. And a direct current may be supplied through the relay 100.

In the 'on' state shown in FIG. 7, if supply of a control signal through the control signal receiving terminals 2 is stopped, the coil 6 is demagnetized, and the vertical magnetic field provided from the coil 6 disappears. Further, since the movable core 10 is also demagnetized, the upward-driving force of the movable core 10 disappears.

Then, the shaft 5 moves downward by an elastic force of the return spring 13, the elastic force applied to an upper end of the shaft 5. As a result, the movable contact arm 4*a* supported by the shaft 5 and the contact spring 7 also moves downward.

The two movable contacts 4 welded on the upper surface of two ends of the movable contact arm 4*a* move downward to be separated from the pair of stationary contacts 3 ('OFF' state). Such an 'off' state is shown in FIG. 2.

In the 'off' state, the conducting path from the positive side main circuit terminal 1 to the negative side main circuit terminal 1 is broken, and supply of a direct current through the relay 100 is stopped.

An electromagnetic repulsive force generated around the contacts during an initial stage of the 'on' operation will be explained with reference to FIG. 8.

As shown in FIG. 8, a current introduced through the stationary contact 3 (the left) connected to the positive side main circuit terminal, flows out through the movable contact arm 4*a* and the stationary contact 3 (the right), sequentially. Since a direction of the incoming current (11) (the lower side) and a direction of the outgoing current (12) (the upper side) are opposite to each other, an electromagnetic repulsive force to push the movable contact arm 4*a* from the stationary contacts is generated between the contacts (refer to the arrow indicating 'F').

An arc generated between the movable contact arm 4*a* and the stationary contacts 3 by a magnetic field (B) from the ferromagnets 12, receives outward pushing forces such as 'F1' and 'F2'.

This may cause a chattering phenomenon that the movable contacts contact the stationary contacts and then are separated from the stationary contacts, repeatedly, during an initial stage of an 'on' operation.

The pre-charge relay is a means to bypass an initial inrush current generated when an electric vehicle is started. Such a chattering phenomenon delays a time to bypass an initial inrush current. This may cause the main relays of the battery disconnect unit to be damaged by the inrush current, and may shorten the lifespan of the relay.

The conventional pre-charge relay has the following problems.

As shown in FIG. 2 or FIG. 7, since only a central part of the movable contact arm 4*a* is supported by the contact spring 7, the two movable contacts 4 contact the two stationary contacts 3 in a very unbalanced state. This may cause only the movable contact 4 and the stationary contact 3 of one side, to be abraded. As a result, a basic performance of the pre-charge relay (a function to bypass an initial inrush current) may not be desirably executed.

SUMMARY

Therefore, an object of some embodiments of the present disclosure is to provide a relay capable of preventing a chattering phenomenon, and capable of solving an unbalanced contact state occurring when contacts come in contact with each other.

To achieve these and other advantages and in accordance with the purpose of this disclosure, as embodied and broadly described herein, there is provided a relay, comprising: a stationary contact having a first stationary contact and a second stationary contact; a movable contact movable to a first position to contact the first stationary contact, and a second position to be separated from the first stationary contact; a conductive connector configured to always electrically connect the movable contact with the second stationary contact; and a driving mechanism configured to provide a driving force to the movable contact such that the movable contact is movable to the first position or the second position.

According to an aspect of some embodiments of the present disclosure, the movable contact is configured with a single contact.

According to another aspect of some embodiments of the present disclosure, the conductive connector is configured with a flexible copper wire having one end connected to the movable contact and another end connected to the second stationary contact.

According to still another aspect of some embodiments of the present disclosure, the relay further comprises a permanent magnet installed only around the first stationary contact, not around the second stationary contact, and configured to protect the contacts from an arc.

According to still another aspect of some embodiments of the present disclosure, the driving mechanism comprises: a coil assembly including a coil which provides a driving force such that the movable contact is positioned at the first position, when the coil is magnetized; a stationary core fixedly-installed in the coil assembly; a shaft configured to support the movable contact in a coaxial state with the movable contact, and formed to be moveable together with the movable contact; a contact spring having one end contacting the movable contact, such that an elastic force is provided to the movable contact in a direction that the is movable contact contacts the first stationary contact; and a movable core connected to a lower part of the shaft, and movable to a position to approach the stationary core and a position to be separated from the stationary core, according to whether the coil has been magnetized or demagnetized.

According to still another aspect of some embodiments of the present disclosure, the shaft is coupled to the movable contact so as to support the movable contact without looseness.

According to still another aspect of some embodiments of the present disclosure, the relay further comprises a return spring installed between the stationary core and the movable core so as to be inserted into an inner diameter portion of one of the stationary core and the movable core, and the return spring configured to provide an elastic force to the movable core in a direction that the movable core is separated from the stationary core.

Further scope of applicability of the present application will become more apparent from the present disclosure given hereinafter. However, it should be understood that the detailed description and specific examples, while indicating embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate embodiments and together with the description serve to explain the principles of the disclosure.

In the drawings.

DETAILED DESCRIPTION

Description will now be given in detail of configurations of a relay according to the present disclosure, with reference to the accompanying drawings.

A configuration and effects of some embodiments of the present disclosure to achieve the aforementioned objects will be understood more clearly with reference to FIGS. 10 to 17.

Figure 14:
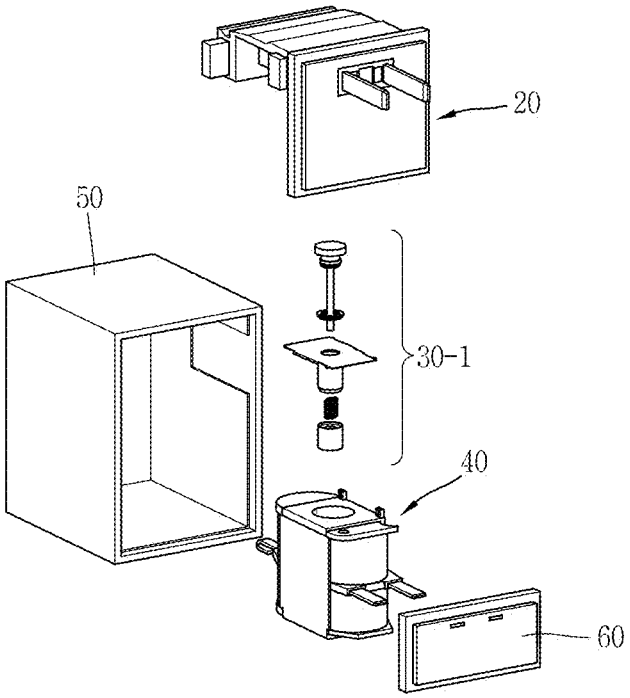
FIG. 14 is an exploded perspective view illustrating a main part of a relay according to some embodiments of the present disclosure.

As shown in FIG. 14, a relay 100 according to some embodiments of the present disclosure comprises an upper mechanism assembly 20, a shaft assembly 30-1 of a driving mechanism, a conductive connector 14, a magnetic coil assembly 40 of the driving mechanism, an enclosure 50 and a lower cover 60.

Figure 11:
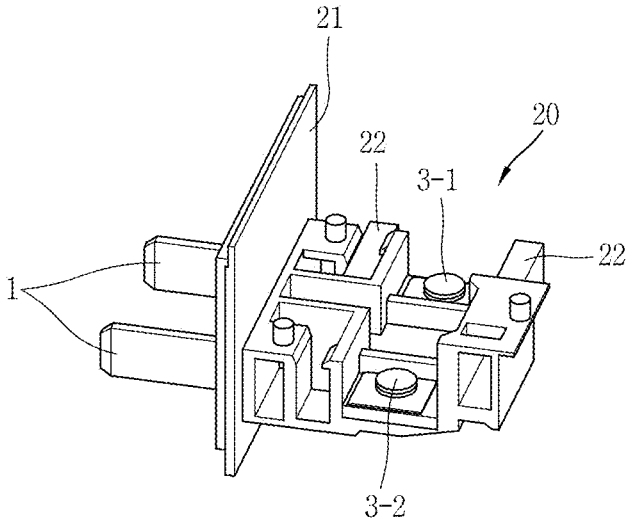
FIG. 11 is a perspective view illustrating a configuration of an upper mechanism assembly of a relay according to some embodiments of the present disclosure.

As shown in FIG. 11, the upper mechanism assembly 20 comprises main circuit terminals 1, stationary contacts (e.g., a first stationary contact 3-1 and a second stationary contact 3-2), ferromagnets 22, an upper cover 21, insulating supporting portions, etc.

FIG. 11 illustrates a configuration of the upper mechanism assembly 20, which shows the upper mechanism assembly 20 upside down like in the conventional art. The upper mechanism assembly 20 is assembled with other components with a posture shown in FIG. 14.

The main circuit terminals 1 have conductor parts of a thin bar shape. Although not shown in FIG. 11 due to the insulating supporting portions, the conductor parts extend to the inside of the relay 100 for passing through the upper cover 21. In FIG. 11, contact parts visible below the first stationary contact 3-1 and the second stationary contact 3-2 are partial regions of the conductor parts.

The first stationary contact 3-1 and the second stationary contact 3-2 comprise one stationary contact connected to a positive side main circuit terminal 1 and another stationary contact connected to a negative side main circuit terminal 1. And the first stationary contact 3-1 and the second stationary contact 3-2 are welded on the contact parts of the main circuit terminals 1, respectively.

The ferromagnets 22 are configured with permanent magnets having a ferromagnetic property. And the ferromagnets 22 are provided to extinguish an arc generated when the first stationary contact 3-1 and a movable contact 4-1 are separated from each other, by inducing the arc to sides of the first stationary contact 3-1 and the movable contact 4-1 by a magnetic flux generated nearby.

In some embodiments of the present disclosure, the ferromagnets 22 are disposed only on right and left sides of the first stationary contact 3-1, and are not installed around the second stationary contact 3-2. The reason is because only the first stationary contact 3-1 is contacted by or separated from the movable contact 4-1 to be explained later. That is, since the second stationary contact 3-2 is always in a connected state to the movable contact 4-1 electrically and mechanically by the conductive connector 14, no arc is generated from the second stationary contact 3-2.

The upper cover 21, configured to shield inner components of the relay from the outside, shields a shaft assembly 30-1 and a magnetic coil assembly 40 which are disposed at an upper part and a middle part of the relay, from the outside. The upper cover 21 is different from the lower cover 60 configured to shield a lower part of the magnetic coil assembly 40 from the outside.

The insulating supporting portions, configured to electrically insulate and support inner extending parts of the main circuit terminals 1 of the relay, the ferromagnets 22, etc., can be formed of a synthetic resin material having an electrical insulating property.

The relay according to some embodiments of the present disclosure comprises a driving mechanism configured to provide a driving force to the movable contact 4-1 such that the movable contact 4-1 can move to a first position to contact the first stationary contact 3-1 or a second position to be separated from the first stationary contact 3-1.

Figure 12:
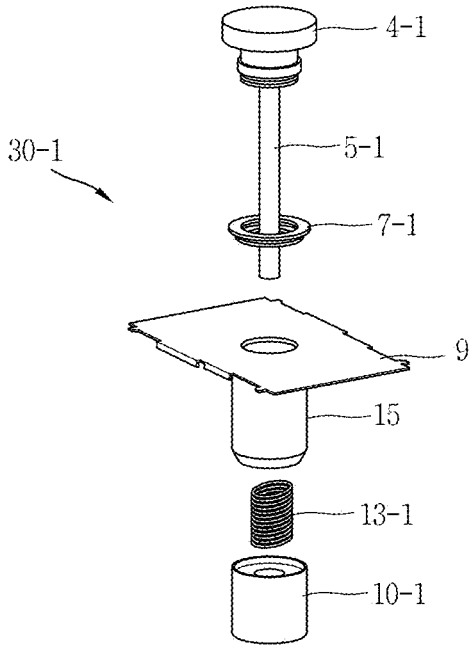
FIG. 12 is an exploded perspective view illustrating a configuration of a driving mechanism of a relay according to some embodiments of the present disclosure.

As shown in FIG. 12, the shaft assembly 30-1 included in the driving mechanism comprises a shaft 5-1, the movable contact 4-1, a contact spring 7-1, a stationary core 15, and a movable core 10-1.

The shaft assembly 30-1 can further comprise a return spring 13-1.

The shaft 5-1 can be formed with a long cylindrical member, and can be formed of an electrical insulating material having rigidity.

An upper end of the shaft 5-1 can be coupled to the movable contact 4-1 by welding, etc., and a lower end of the shaft 5-1 is inserted into a movable core 10 and then can be coupled to the movable core 10 by a connection member such as a pin.

The shaft 5-1 supports the movable contact 4-1 in a coaxial state with the movable contact 4-1 (refer to 'A' in FIG. 10), and is movable together with the movable contact 4-1.

Figure 1:
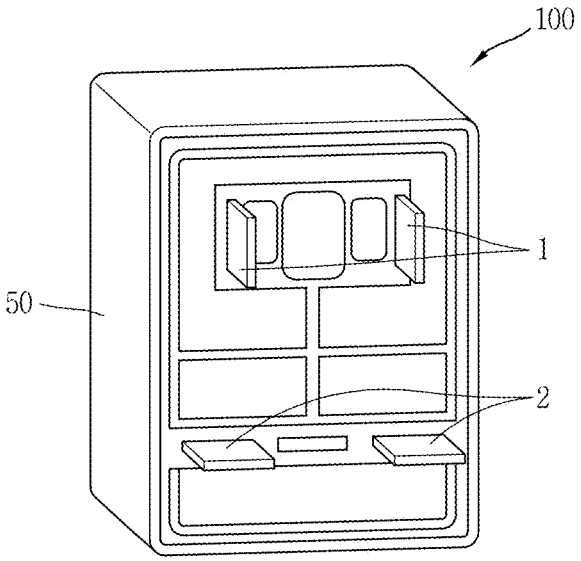
FIG. 1 PRIOR ART
FIG. 1 is a perspective view illustrating an appearance of a relay in accordance with the conventional art or according to some embodiments of the present disclosure.
Figure 2:
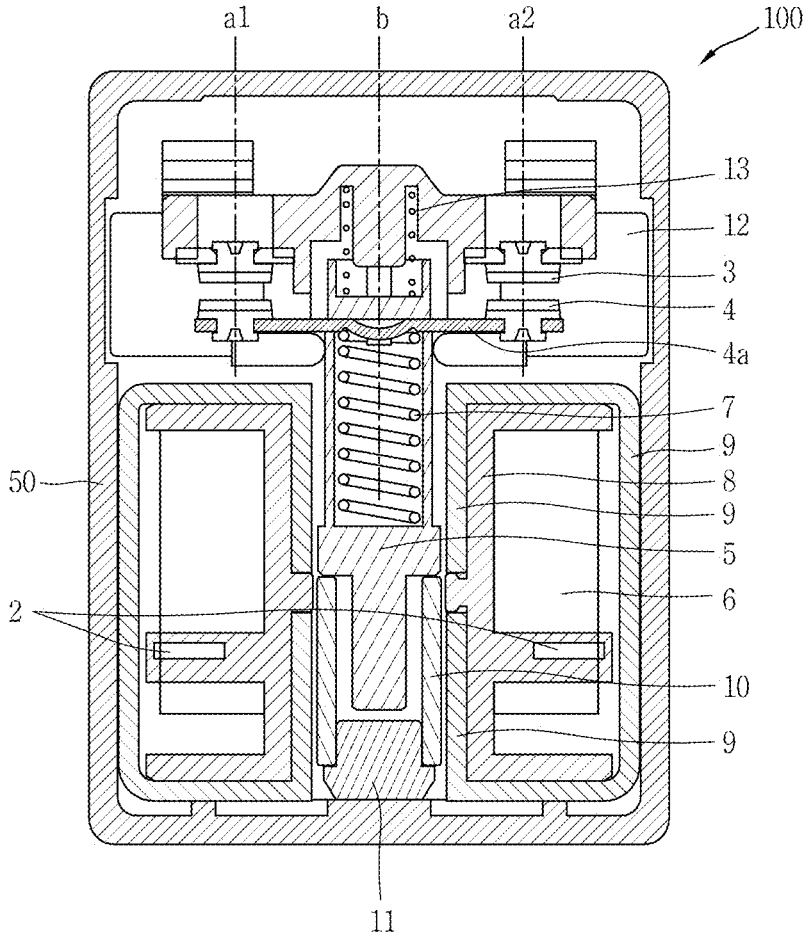
FIG. 2 PRIOR ART
FIG. 2 is a longitudinal sectional view illustrating inner components and an 'off' state of a relay in accordance with the conventional art.
Figure 3:
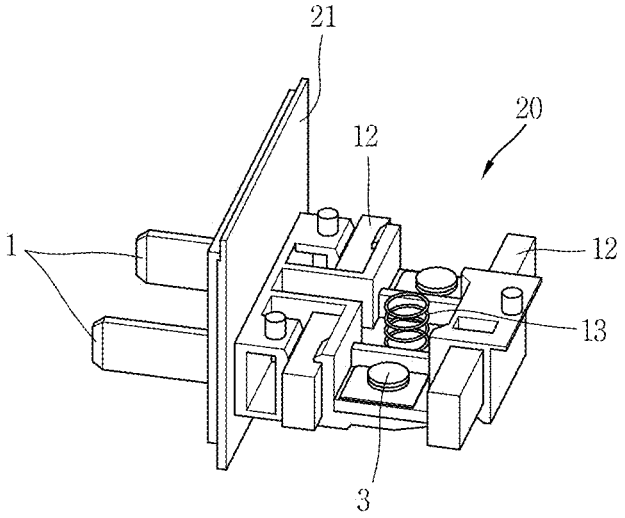
FIG. 3 PRIOR ART
FIG. 3 is a perspective view illustrating a configuration of an upper mechanism assembly of a relay in accordance with the conventional art.

With such a configuration, when compared with the conventional art where the movable contacts (refer to 'a1 and a1' in FIG. 2) and the shaft (refer to 'b' in FIG. 2) are not coaxial with each other, a driving force to move the movable contact 4-1 can be transmitted exactly.

In a coupled state, the shaft 5-1 and the movable core 10 can be integrally moved in the same direction.

Figure 10:
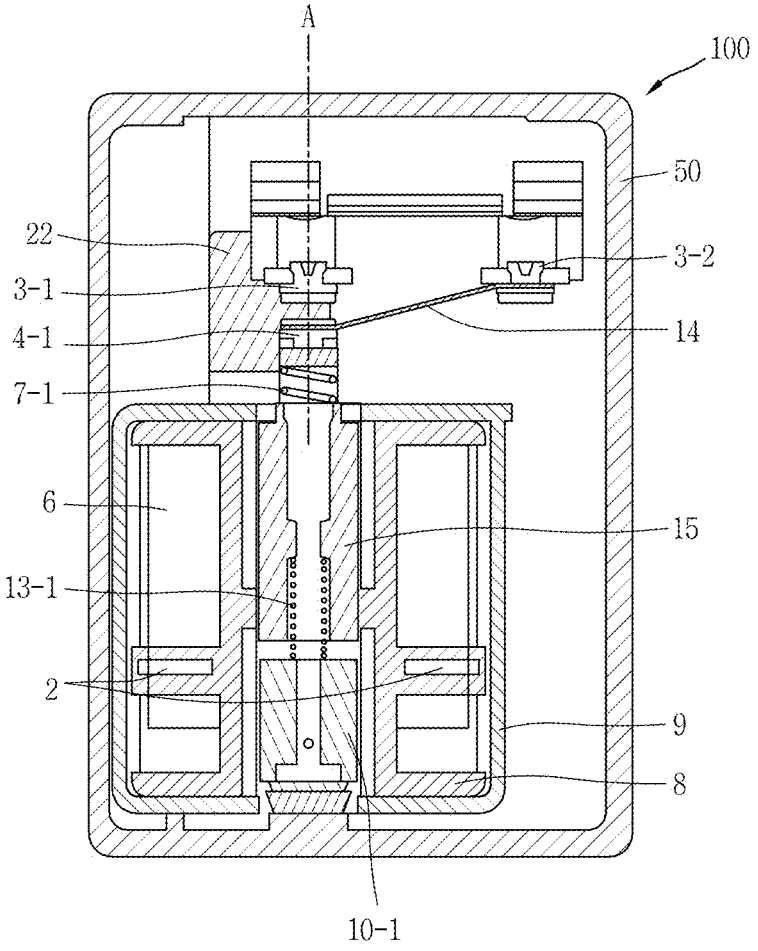
FIG. 10 is a longitudinal sectional view illustrating inner components and an 'off' state of a relay according to some embodiments of the present disclosure.

The movable contact 4-1 is formed of a conductive material. As shown in FIG. 10 or FIG. 12, the movable contact 4-1 is installed such that a lower part thereof receives an elastic biasing pressure in upward direction by the contact spring 7-1, for contact with the first stationary contact 3-1 disposed thereabove.

Figure 4:
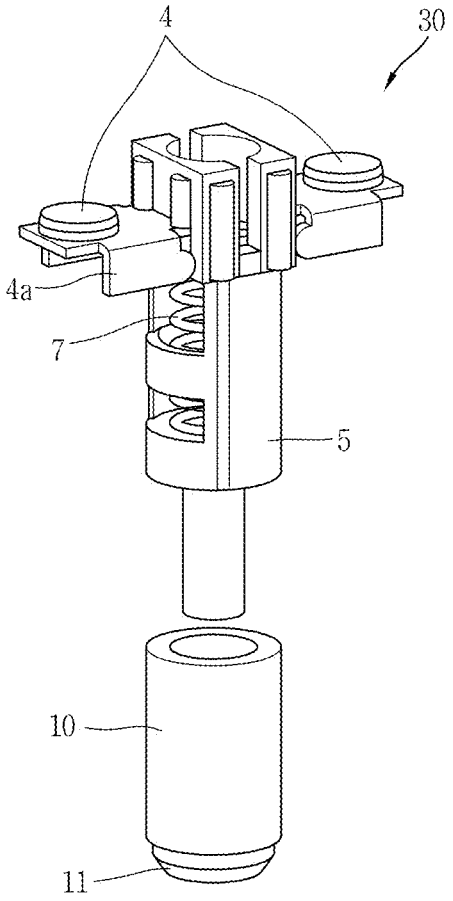
FIG. 4 PRIOR ART
FIG. 4 is a perspective view illustrating a configuration of a movable part assembly of a relay in accordance with the conventional art.
Figure 5:
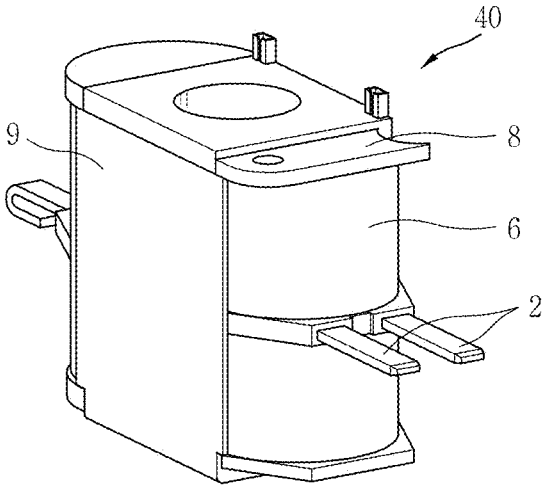
FIG. 5 PRIOR ART
FIG. 5 is a perspective view illustrating a configuration of a magnetic coil assembly of a relay in accordance with the conventional art.
Figure 6:
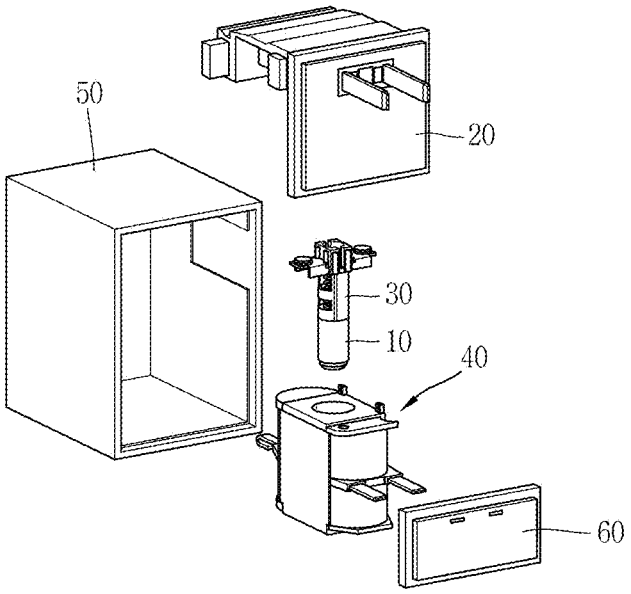
FIG. 6 PRIOR ART
FIG. 6 is an exploded perspective view illustrating a main part of a relay in accordance with the conventional art.
Figure 7:
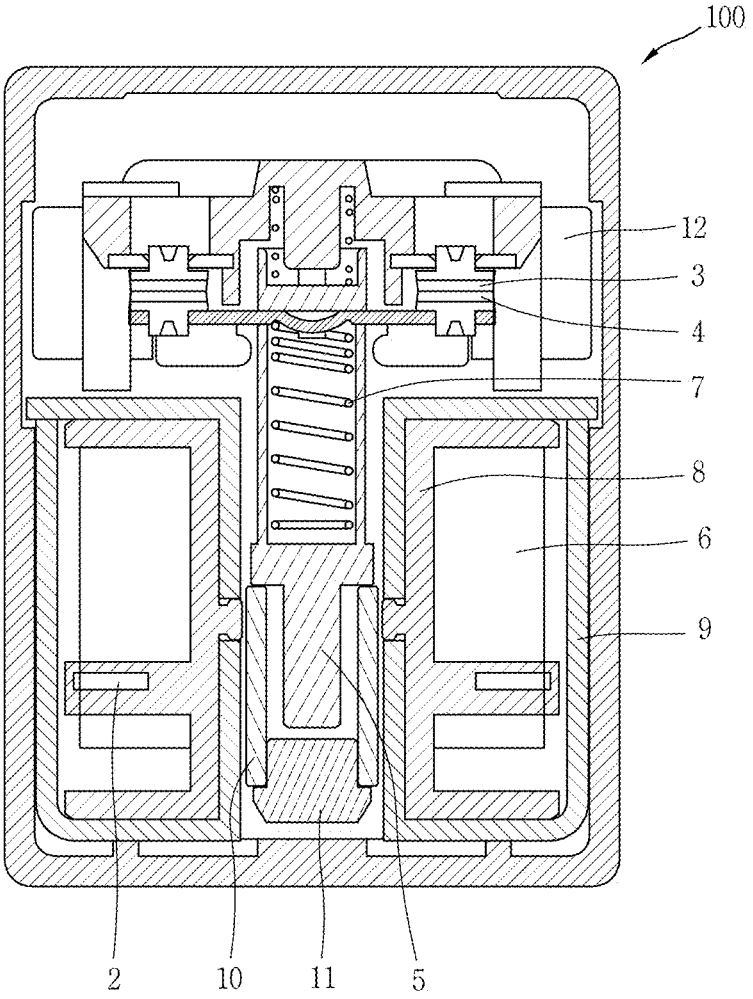
FIG. 7 PRIOR ART
FIG. 7 is a longitudinal sectional view illustrating an 'on' state of a relay in accordance with the conventional art.
Figure 8:
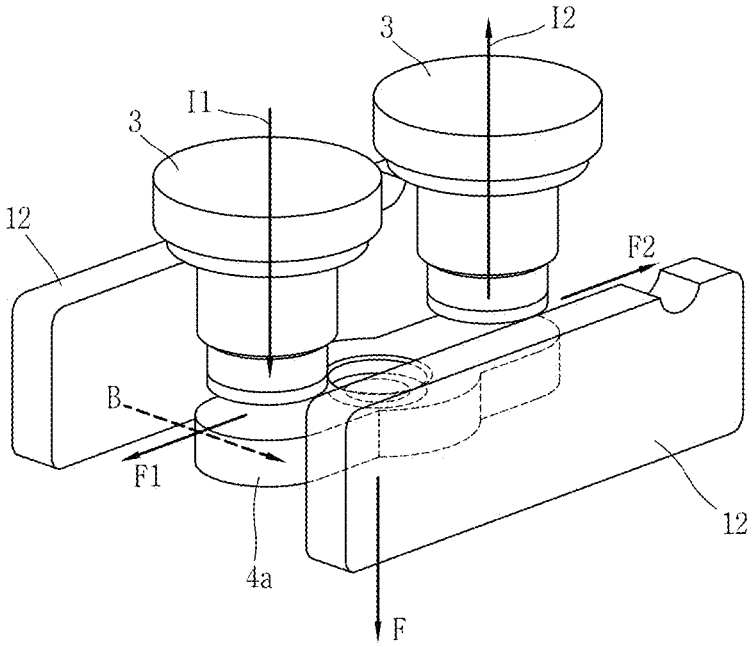
FIG. 8 PRIOR ART
FIG. 8 is a view illustrating a phenomenon that an electromagnetic repulsive force is generated according to directions of an incoming current and an outgoing current in a relay in accordance with the conventional art.
Figure 9:
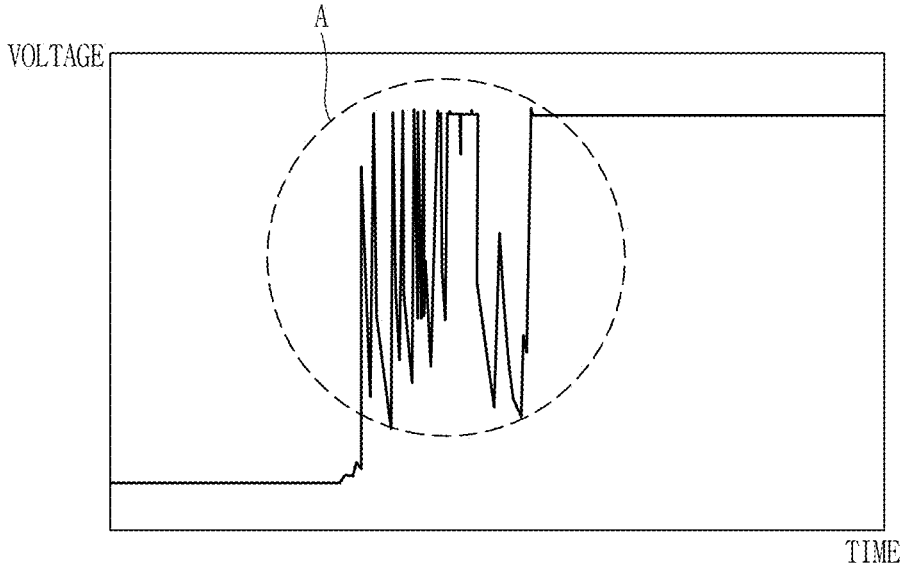
FIG. 9 PRIOR ART
FIG. 9 is a waveform diagram illustrating a chattering phenomenon due to an electromagnetic repulsive force, in a relay in accordance with the conventional art.

As shown in FIG. 4, in the conventional art, the movable contacts 4 and the movable contact arm 4*a* are supported only by the contact spring 7 unstably to thus move in the hollow portion of the shaft 5. On the other hand, in some embodiments of the present disclosure, a contact position between the movable contact 4-1 and the first stationary contact 3-1 can be maintained constantly, because there is no movement of the movable contact 4-1 relative to the shaft 5-1 as the movable contact 4-1 is coupled to the shaft 5-1.

According to an aspect of some embodiments of the present disclosure, the movable contact 4-1 is configured to have a single contact, unlike the conventional movable contacts having a pair of contacts.

The movable contact 4-1 is moveable to a first position to contact the first stationary contact 3-1, or a second position to be separated from the first stationary contact 3-1.

Referring to FIG. 10 or FIG. 12, the contact spring 7-1 has one end (an upper end in the drawing) contacting the movable contact 4-1, in order to provide an elastic force to the movable contact 4-1 in a direction that the movable contact 4-1 contacts the first stationary contact 3-1.

In some embodiments of the present disclosure, as shown in FIG. 10 or FIG. 12, another end of the contact spring 7-1 can be supported by an upper part of a yoke 9. In a modified embodiment, said another end of the contact spring 7-1 can be supported by an upper surface of the movable core 10-1. The upper surface of the movable core 10-1 can have a recessed portion for accommodating said another end of the contact spring 7-1.

The contact spring 7-1 can be configured with a compression coil spring. An upper end of the contact spring 7-1 is supported by a lower part of the movable contact 4-1, and a lower end of the contact spring 7-1 is supported by the upper part of the yoke 9 as aforementioned according to some embodiments.

In some embodiments, the contact spring 7-1 can be configured with a conical compression coil spring, e.g., a tapered compression coil spring having a smaller diameter toward the lower side, such that the lower end of the contact spring 7-1 is inserted to be supported in an opening formed at a central region of the upper part of the yoke 9.

The stationary core 15 can be configured with a cylindrical member formed of an electrical insulating material. The stationary core 15 has a central opening for allowing the shaft 5-1 to vertically pass therethrough, at a central region thereof in a radius direction. And a lower spring supporting groove having a larger diameter than a middle portion of the central opening, and the lower spring supporting groove formed at a lower part of the central opening supports one end (an upper end in FIG. 10) of a return spring 13-1. For this, an outer diameter of the return spring 13-1 is formed to be smaller than a diameter of the lower spring supporting groove, and is formed to be larger than the middle portion of the central opening of the stationary core 15.

The stationary core 15 serves to determine a moving distance (S) of the movable core 10-1, and to support the upper end of the return spring 13-1 when the relay of some embodiments of the present disclosure is turned on.

The movable core 10-1 can be configured with a core having a hollow cylindrical shape.

Like in the conventional art, a rubber pad may be forcibly-inserted into a lower end of the movable core 10, for coupling with the movable core 10.

The rubber pad may be provided to attenuate collision noise and an impact generated when the movable core 10-1 collides with an inner bottom surface of the enclosure 50 when it returns to the lower original position by the return spring 13-1, when the magnetic coil assembly 40 is demagnetized.

The movable core 10-1 and the shaft 5-1 can be coupled with each other, as a lower part of the shaft 5-1 is inserted into the hollow portion of the movable core 10-1, then a pin passes through the lower part of the shaft 5-1 in a horizontal direction, and two ends of the pin are compressed.

The movable core 10-1 connected to the lower part of the shaft 5-1 is moveable to a position to approach the stationary core 15 or a position to be away from the stationary core 15, according to a coil 6 of the magnetic coil assembly 40 to be explained later is magnetized or demagnetized.

That is, the movable core 10-1 is magnetized by a magnetic field generated from the magnetic coil assembly 40, and upward-moves by a magnetic field of a vertical direction applied from the magnetic coil assembly 40 or is demagnetized together with the magnetic coil assembly 40 when the magnetic coil assembly 40 is demagnetized. Then, the movable core 10-1 downward-moves by an elastic force of the return spring 130 applied to an upper end of the shaft 5-1.

The return spring 13-1 is installed between the stationary core 15 and the movable core 10-1 so as to be inserted into an inner diameter portion of one of the stationary core 15 and the movable core 10-1 (inserted into the stationary core in FIG. 10), and provides an elastic force to the movable core 10-1 in a direction that the movable core 10-1 is separated from the stationary core 15.

An elastic constant (coefficient of elasticity) of the return spring 13-1 is larger than that of the contact spring 7-1, in order to overcome an elastic force of the contact spring 7-1 when the coil 6 is demagnetized, and such that a driving force to move the movable core 10-1 to a position to be separated from the stationary core 15 is provided to the movable core 10-1.

The conductive connector 14 of the relay according to some embodiments of the present disclosure is provided as a means to always electrically connect the movable contact 4-1 and the second stationary contact 3-2 with each other.

In some embodiments of the present disclosure, the conductive connector 14 is configured with a flexible copper wire (flexible wire) having one end connected to the movable contact 4-1 and another end connected to the second stationary contact 3-2. In some embodiments, the flexible copper wire may be replaced by a wire having a length long enough not to disturb a movement of the movable contact 4-1. The conductive connector 14 may be replaced by any conductive member which always electrically connect the movable contact 4-1 and the second stationary contact 3-2 with each other with allowing a movement of the movable contact 4-1.

One end and another end of the conductive connector 14 may be connected to each other by welding (e.g., spot-welding) the movable contact 4-1 and the second stationary contact 3-2.

Since the movable contact 4-1 and the second stationary contact 3-2 are always in a connected state by the conductive connector 14, a spacing distance (insulating distance)

between the movable contact 4-1 and the first stationary contact 3-1 according to some embodiments is formed to be as long as two-times of the conventional one, such that an insulating distance between the movable contact 4-1 and the first stationary contact 3-1 is obtained in an 'off' state of the relay.

A configuration of the magnetic coil assembly 40 of the driving mechanism will be explained with reference to FIGS. 10 and 13.

Figure 13:
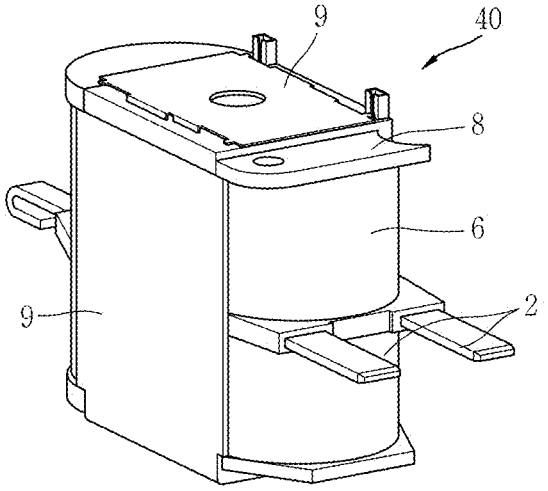
FIG. 13 is a perspective view illustrating a configuration of a magnetic coil assembly of a relay according to some embodiments of the present disclosure.

As shown in FIG. 10 or FIG. 13, the magnetic coil assembly 40 comprises a bobbin 8, a coil 6, a yoke 9 and control signal receiving terminals 2.

Like in the conventional art, the bobbin 8 includes a body portion having a hollow cylindrical shape to allow the movable core 10 to be inserted thereinto or to be separated therefrom, and flange portions formed at upper and lower ends of the body portion and configured to determine a winding limit of the coil 6. The coil 6 is wound on the body portion.

The coil 6 is wound on the body portion of the bobbin 8, and is magnetized or demagnetized according to whether a control signal is applied to the control signal receiving terminals 2 or not.

A magnetic field by the coil 6 may be greater than the conventional one, since an insulating distance between the movable contact 4-1 and the first stationary contact 3-1 is longer than the conventional one in an 'off' state of the relay. As a result, a size of the bobbin 8 may be larger than the conventional one, and the turn number of windings of the coil 6 on the bobbin 8 may be also more than that of the conventional one.

As shown in FIG. 10, the yoke 9 is formed to enclose the bobbin 8, and provides a circulation path of a magnetic flux generated from the coil 6 when the coil 6 is magnetized.

In some embodiments of the present disclosure, the stationary core 15 is welded to a bottom surface of the upper part of the yoke 9 by a laser welding, thereby being coupled to the yoke 9.

Referring to FIG. 10 or FIG. 13, the control signal receiving terminals 2 are installed to pass through the wound coil 6. When a control signal is received through the control signal receiving terminals 2, the coil 6 is magnetized by the control signal. And the coil 6 is demagnetized when the reception of the control signal is stopped.

Referring to FIG. 10 or FIG. 14, the enclosure 50 is a means to accommodate therein the components of the relay 100 according to some embodiments of the present disclosure, and may be formed of a synthetic resin material having an electrical insulating property. As shown in FIG. 14, the enclosure 50 may be formed as a rectangular parallelepiped member having one open surface and five closed surfaces, and having an empty inner space, in order to accommodate the components of the relay 100 therein.

As shown in FIG. 14, the lower cover 60, a cover to shield the inner components of the relay 100 from the outside, shields a lower part of the magnetic coil assembly 40 positioned at a lower part of the relay 100 from the outside. The lower cover 60 is different from the upper cover 21 which shields the upper mechanism assembly 20 and the movable part assembly 30 which are disposed at an upper part and a middle part of the relay 100, from the outside.

The lower cover 60 has two openings formed to correspond to the control signal receiving terminals 2, such that the control signal receiving terminals 2 are exposed to the outside through the openings.

An operation of the relay 100 according to some embodiments of the present disclosure will be explained in brief.

Referring to FIG. 10, in an 'off' state of the relay 100, once a control signal is applied through the control signal receiving terminals 2, the coil 6 is magnetized. In this case, the movable core 10-1 is also magnetized by a vertical magnetic field applied from the coil 6, thereby moving upward.

Then, the shaft 5-1 of which lower part has been coupled to the movable core 10-1 moves upward together with the movable core 10-1, with overcoming an elastic force of the return spring 13-1. As a result, the movable contact 4-1 supported by the shaft 5-1 also moves upward.

The movable contact 4-1 moves upward to contact the first stationary contact 3-1 (turns into 'ON' state). Such an 'on' state of the relay is shown in FIG. 15.

As a closed circuit is formed from the positive side main circuit terminal 1 to the first stationary contact 3-1, the movable contact 4-1, the conductive connector 14, the second stationary contact 3-2 and the negative side main circuit terminal 1, a conducting path from the positive side main circuit terminal 1 to the negative side main circuit terminal 1 may be formed. And a DC power can be supplied through the relay 100.

Figure 15:
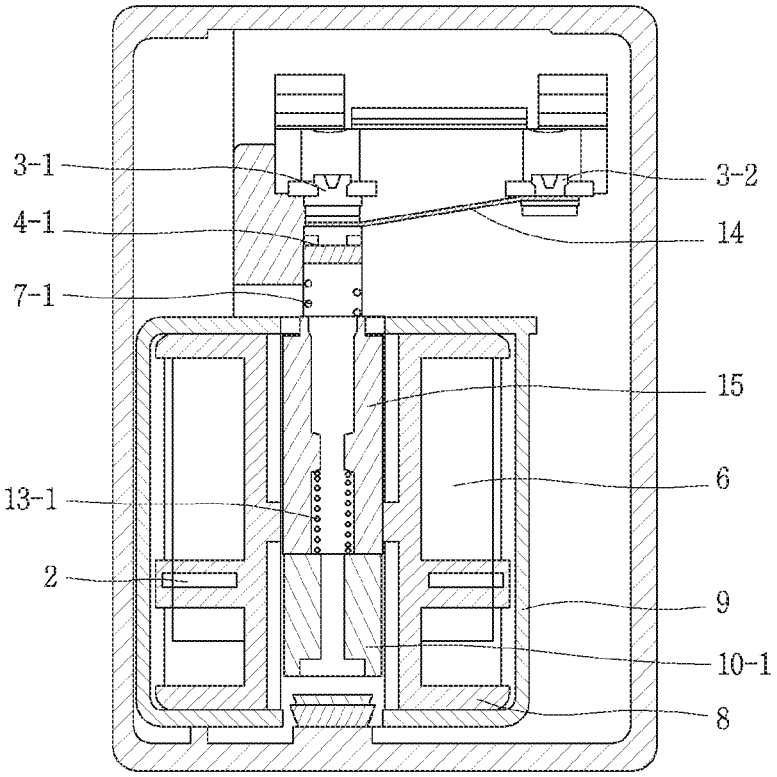
FIG. 15 is a longitudinal sectional view illustrating an 'on' state of a relay according to some embodiments of the present disclosure.

In the 'on' state shown in FIG. 15, if supply of a control signal through the control signal receiving terminals 2 is stopped, the coil 6 is demagnetized, and the vertical magnetic field provided from the coil 6 disappears. Further, since the movable core 10-1 is also demagnetized, the upward-driving force of the movable core 10-1 disappears.

Then, the shaft 5-1 moves downward by an elastic force of the return spring 13-1, the elastic force applied to an upper surface of the movable core 10-1. As a result, the movable contact 4-1 supported by the shaft 5-1 also moves downward.

The movable contact 4-1 moves downward to be separated from the first stationary contact 3-1 (turns into 'OFF' state). Such an 'off' state of the relay is shown in FIG. 10.

In the 'off' state, the conducting path from the positive side main circuit terminal 1 to the negative side main circuit terminal 1 is interrupted, and supply of the DC power through the relay 100 is stopped.

Figure 16:
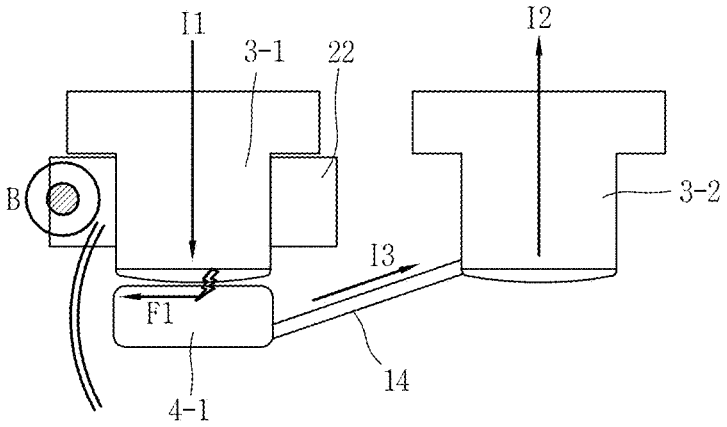
FIG. 16 is a view illustrating that an electromagnetic repulsive force is decreased in a relay according to the present disclosure.

An electromagnetic repulsive force generated around the contacts during an initial stage of the 'on' operation will be explained with reference to FIG. 16.

As shown, a current flowed in through the first stationary contact 3-1 connected to the positive side main circuit terminal, flows out through movable contact 4-1, the conductive connector 14 and the second stationary contact 3-2, sequentially. Since a direction of the incoming current (11) (the lower side) and a direction of the outgoing current (12) (the upper side) are opposite to each other, an electromagnetic repulsive force to push the movable contact 4-1 from the first stationary contact 3-1 is generated between the contacts. However, the electromagnetic repulsive force according to some embodiments of the present disclosure may be minimized in comparison with the conventional one, since the second stationary contact 3-2 is in a connected state to the movable contact 4-1 through the conductive connector 14. In this case, a current which flows from the movable contact 4-1 to the second stationary contact 3-2 through the conductive connector 14 is indicated by '13'.

An arc generated between the movable contact 4-1 and the first stationary contact 3-1 receives an outward pushing force such as 'F1' by a magnetic field (B) from the ferromagnet 22.

Figure 17:
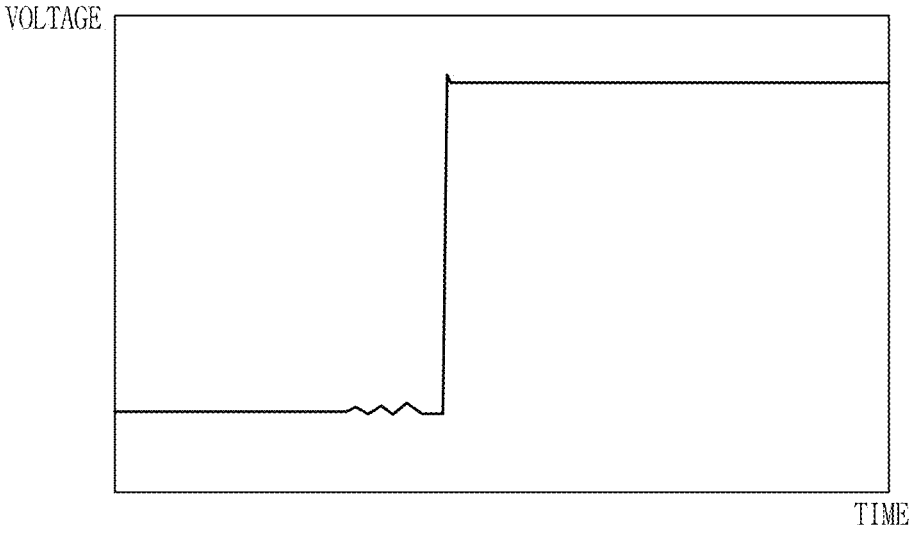
FIG. 17 is a waveform diagram illustrating that a chattering phenomenon due to an electromagnetic repulsive force in a relay according to some embodiments of the present disclosure is more reduced than in a relay in accordance with the conventional art.

As shown in FIG. 17, a chattering phenomenon that the movable contact contacts the stationary contact and then is separated from the stationary contact, repeatedly, during an initial stage of an 'on' operation of the relay may be significantly reduced.

As aforementioned, the relay according to some embodiments of the present disclosure may have the following advantages.

Firstly, since the relay according to some embodiments of the present disclosure includes the conductive connector for always electrically connecting the movable contact and one stationary contact with each other, an electromagnetic repulsive force is more reduced during a circuit closing operation ('ON' operation) than in the conventional art, and a chattering phenomenon is significantly reduced.

Furthermore, since the movable contact is configured with a single contact, the conventional problem that only one of contacts is abraded due to biased contact may be prevented. This may enhance reliability in operating a pre-charge relay, and may prolong the lifespan of the contact.

Further, the conductive connector is configured with a flexible copper wire having one end connected to the movable contact and another end connected to the second stationary contact. With such a configuration, the conductive connector may provide an excellent mechanical durability with being flexible, despite frequent movements of the movable contact and contact impact between the contacts, and may provide an excellent function for a conducting path.

Further, the relay of some embodiments of the present disclosure includes permanent magnets installed only around the first stationary contact, not around the second stationary contact, and configured to protect the contacts from an arc. This may allow the number of the permanent magnets in some embodiments of the present disclosure, to be smaller than the number of the conventional permanent magnets which should be installed around both of first and second stationary contacts. This may more reduce fabrication costs of the pre-charge relay, than in the conventional art.

Furthermore, the driving mechanism includes the shaft configured to support the movable contact in a coaxial state with the movable contact, and configured to be moveable together with the movable contact. This may allow a driving force for moving the movable contact to be transmitted more effectively, when compared with the conventional art where a movable contact and a shaft are not coaxial with each other.

Further, the shaft is coupled to the movable contact integrally in the relay according to some embodiments of the present disclosure. This configuration may allow the movable contact to have a constant contact position with the stationary contact, when compared with the conventional art where a movable contact is movable relatively to the shaft.

Further, the relay according to some embodiments of the present disclosure further includes the return spring installed between the stationary core and the movable core so as to be inserted into an inner diameter portion of one of the stationary core and the movable core. This configuration may provide an elastic force to the movable core in a direction that the movable core is separated from the stationary core. Besides, this may allow the return spring to be stably and constantly disposed at the inner diameter portion of one of the stationary core and the movable core.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A relay, comprising:

a stationary contact having a first stationary contact and a second stationary contact;

a movable contact movable to a first position to contact the first stationary contact, and a second position to be separated from the first stationary contact, the movable contact connected to the second stationary contact;

a conductive connector configured to electrically connect the movable contact with the second stationary contact, the conductive connector having one end connected to the movable contact and another end connected to the second stationary contact;

a driving mechanism configured to provide a driving force to the movable contact such that the movable contact is moveable to the first position or the second position, and a permanent magnet installed around the first stationary contact, and not around the second stationary contact, and configured to protect the contacts from an arc, wherein the movable contact is configured with a single contact.

2. The relay of claim 1, wherein the conductive connector is configured with a flexible copper wire having one end connected to the movable contact and another end connected to the second stationary contact.

3. The relay of claim 1, wherein the driving mechanism comprises:

a coil assembly including a coil configured to provide a driving force such that the movable contact is positioned at the first position, when the coil is magnetized;

a stationary core fixedly-installed in the coil assembly;

a shaft configured to support the movable contact in a coaxial state with the movable contact, and formed to be moveable together with the movable contact;

a contact spring having one end contacting the movable contact, such that an elastic force is provided to the movable contact in a direction that the movable contact contacts the first stationary contact; and a movable core connected to a lower part of the shaft, and movable to a position to approach the stationary core and a position to be separated from the stationary core, according to whether the coil has been magnetized or demagnetized.

4. The relay of claim 3, wherein the shaft is coupled to the movable contact so as to support the movable contact without looseness.

5. The relay of claim 3, further comprising a return spring installed between the stationary core and the movable core and configured to be inserted into an inner diameter portion of one of the stationary core and the movable core, and the return spring configured to provide an elastic force to the movable core in a direction that the movable core is separated from the stationary core.

* * * * *